US005766645A

United States Patent [19]

Kaminski

[11] Patent Number: 5,766,645

[45] Date of Patent: Jun. 16, 1998

[54] CONCRETE FORMING SYSTEM FOR STACK CONSTRUCTION

[75] Inventor: Jan Kaminski, Ottawa, Canada

[73] Assignee: Sci Sitecast International, Inc., Nepean, Canada

[21] Appl. No.: 731,553

[22] Filed: Oct. 16, 1996

[51] Int. Cl.[6] ..... B28B 7/02; B28B 7/22; E04G 11/08

[52] U.S. Cl. ..... 425/63; 264/33; 264/34; 249/20; 249/21; 249/120; 249/126; 249/139; 249/155; 249/192

[58] Field of Search ..... 425/63; 249/120, 249/139, 160, 192, 15, 20, 18, 21, 126, 158, 155; 264/33, 34

[56] References Cited

U.S. PATENT DOCUMENTS

| | | | |
|---|---|---|---|
| 128,670 | 7/1872 | Stephens . | |
| 1,168,492 | 1/1916 | Freund . | |
| 1,234,244 | 7/1917 | Willsie . | |
| 1,326,902 | 1/1920 | Atterbury . | |
| 1,463,841 | 2/1923 | Richman . | |
| 1,657,566 | 1/1928 | Crozier . | |
| 2,531,990 | 11/1950 | Rappoli . | |
| 2,657,448 | 11/1953 | Faye | 249/20 |
| 2,837,807 | 6/1958 | McGraw | 249/192 |
| 3,182,948 | 5/1965 | Lawrence . | |
| 3,495,800 | 2/1970 | Fisher . | |
| 3,618,181 | 11/1971 | Veale . | |
| 3,999,913 | 12/1976 | Branitzky . | |
| 4,062,514 | 12/1977 | Scott-King | 249/192 |
| 4,067,941 | 1/1978 | Gaudelli et al. . | |
| 4,228,985 | 10/1980 | Gandelli et al. | 249/120 |
| 4,397,441 | 8/1983 | Manderla | 249/20 |
| 5,029,804 | 7/1991 | McGregor | 249/20 |
| 5,205,942 | 4/1993 | Fitzgerald | 249/192 |
| 5,372,349 | 12/1994 | Elmore | 249/155 |

*Primary Examiner*—Khanh P. Nguyen
*Attorney, Agent, or Firm*—Nixon & Vanderhye P.C.

[57] ABSTRACT

The present invention relates to a concrete forming system and method permitting a series of stacked concrete slabs to be formed at a work site. The system includes a vertical support member configured to the work surface, concrete form members for defining a desired shape for a concrete slab and horizontal adjustment members for attachment of the form members to the vertical support member. Through use of the system, a series of stacked concrete slabs can be successively poured one on top of the other.

11 Claims, 3 Drawing Sheets

CONCRETE FORMING SYSTEM FOR STACK CONSTRUCTION

The present invention relates to a concrete forming system and method permitting a series of stacked concrete slabs to be formed at a work site. The system includes a vertical support member configured to the work surface, concrete form members for defining a desired shape for a concrete slab and horizontal adjustment members for attachment of the form members to the vertical support member. Through the use of the system, a series of stacked concrete slabs can be successively poured one on top of the other thereby providing an efficient system of producing concrete slabs. The invention has particular use in the fabrication of concrete slabs for tilt-up construction.

BACKGROUND OF THE INVENTION

In many locations around the globe, there is a need for low cost and easily-fabricated housing to meet the housing requirements of many people in either their native rural regions or in growing urban areas. This is particularly true in third world countries.

For example, in areas where lumber materials are scarce or unavailable, it is often difficult to provide adequate housing for people from locally available construction materials. Accordingly, it is often required that construction materials are brought into an area or pre-fabricated housing components are used to build housing in that particular area. Further problems arise when the location of a building site is distant from a supplier of materials or a manufacturing facility where transportation of materials is either difficult, expensive or impossible. In order to solve such problems, housing projects in particular locations, often use cement components to form basic housing structures. The advantages of concrete components are that they are durable and inexpensive when used in the manufacture of housing units and that often, some or all of the stone/sand/water/cement ingredients may be available locally. Furthermore, the transportation of concrete ingredients is generally easier and less expensive than transporting pre-formed components. The disadvantage of using concrete components is the difficulty and expense of transporting pre-formed components from a manufacturing facility to a particular work site.

Thus, there has been a need to develop a system to facilitate the manufacture of concrete components at a building site in order to overcome the difficulty and expense of transporting pre-formed components.

In such a manufacturing system, in order to fabricate components to a uniform standard, it is necessary to build a casting bed which may be used to build the required components. Such a casting bed would typically be a large flat and level concrete surface built at a suitable location directly on the ground, the casting bed being sufficiently large to allow numerous concrete components to be made. With most concrete components, the poured concrete will typically require a full seven days to cure in order to ensure that it is sufficiently strong to be moved. Accordingly, concrete components after pouring should be allowed to cure in-situ for at least seven days to allow for sufficient component strength to develop.

However, it is inefficient to leave a fabrication site dormant for seven days after pouring a single concrete slab as considerable time would be wasted at the work site waiting for the concrete to cure. Similarly, it is inefficient to fabricate numerous casting beds to enable many concrete components to be poured.

Accordingly, it is desirable that a single casting bed be fabricated of sufficient size to allow the fabrication of a number of components which can also allow identical components to be cast one on top of the other.

For example, in the situation of a large housing project in which it is desired to build a number of housing units from concrete components, each housing unit may be built from separate concrete slabs, a slab for each wall, main interior partitions and roof components. Accordingly, a casting bed of a size sufficient to allow for the casting of all the components required for a housing unit can be built. As indicated above, it would be inefficient to use the casting bed for a single housing unit at a time as only a single housing unit could be built every seven days. Accordingly, it is desirable to enable identical components to be poured each day, one on top of the other on the casting bed in order to allow a larger number of units to be fabricated within a specific period of time.

Accordingly, if seven identical components can be cast one on top of the other on successive days and, following the last casting, allowed to cure for seven, components for a total of seven housing units could be manufacture in a total of 14 days (seven days of casting, followed by seven days of curing for the entire stack of components). Thus, the average time to prepare components for each housing unit would only be two days.

In regions where this form of construction is utilized, this method can allow for the efficient utilization of equipment and labor as various construction crews can be kept working with less idle time.

Specifically, in order to ensure that the manufacture of a concrete components progresses efficiently, there has been a need for a forming system which is easily assembled and adjustable to ensure that each concrete component is fabricated within strict tolerances, that is durable and corrosion resistant to enable repeated use and handling and where each component of the forming system is stackable for ease of shipping and handling to and from a work-site.

Thus, while stacked construction is desirable, hereto before, the components utilized in the concrete forming and pouring stages of the construction have been limited with respect to the above problems. A review of the prior art has revealed U.S. Pat. No. 3,182,948, U.S. Pat. No. 3,495,800, U.S. Pat. No. 128,670, U.S. Pat. No. 1,1168,492, U.S. Pat. No. 1,326,902, U.S. Pat. No. 1,657,566, U.S. Pat. 2,531,990, U.S. Pat. 1,234,244, U.S. Pat. No. 3,99,913 and U.S. Pat. 4,067,941 which do not address the above problems.

SUMMARY OF THE INVENTION

In accordance with the invention, a concrete forming system enabling stacked pourings of concrete is provided, the concrete forming system comprising:

- a concrete form member;
- a vertical plate member adapted for attachment to a work surface;
- a vertical stiffening member adapted for attachment to the vertical plate member and for stiffening the vertical plate member;
- horizontal adjustment member adapted for attachment to the vertical plate member, the horizontal adjustment member including means for horizontal positioning of the horizontal adjustment member and means for anchoring the concrete form member to the horizontal adjustment member.

In more specific embodiments, the concrete form member has a c-profile with an upwardly projecting edge and a downwardly projecting edge for configuration to corresponding recessed channels on the horizontal adjustment member and the concrete form member includes a tongue for attachment of adjacent concrete form members to one another.

Still further, the vertical support member may include a base member adapted for attachment to the work surface and a vertical member, the base member and vertical 90° with respect to one another and the vertical stiffening member may have a triangular plate member, a vertical flange on one edge of the triangular plate member adapted for attachment to the vertical member and a horizontal flange adapted for attachment to the base member.

In a further embodiment, the horizontal adjustment member includes at least one horizontal slot adapted for configuration of the horizontal adjustment member to the vertical support member.

In a specific embodiment, a concrete forming system enabling stacked pourings of concrete is provided, comprising:

a concrete form member having a c-profile with an upwardly projecting edge and a downwardly projecting edge, the concrete form member having a tongue for attachment of adjacent concrete form members to one another;

a vertical plate member having a base member adapted for attachment to the work surface and a vertical member, the base member 90° with respect to the vertical member;

a vertical stiffening member adapted for attachment to the vertical plate member and for stiffening the vertical plate member, the vertical stiffening member having a triangular plate member, a vertical flange on one edge of the triangular plate member adapted for attachment to the vertical member and a horizontal flange adapted for attachment to the base member;

horizontal adjustment member adapted for attachment to the vertical plate member and the upwardly projecting edge and downwardly projecting edge of the concrete form member, the horizontal adjustment member including at least one horizontal slot adapted for configuration of the horizontal adjustment member to the vertical support member.

In accordance with a method of manufacturing stacked concrete slabs on a work surface with the concrete forming system of the invention, a method is provided comprising the steps of:

a) configuring concrete form members to the work surface wherein the concrete form members define a desired shape;

b) attaching the horizontal adjustment members to the concrete form members;

c) attaching the horizontal adjustment members to vertical support members, the vertical support members attached to the work surface adjacent the concrete form members;

d) pouring a first layer of concrete within the desired shape to form a concrete slab;

e) allowing the first layer of concrete to cure wherein the concrete slab defines a new work surface;

f) repeating steps a) to e) on the new work surface.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
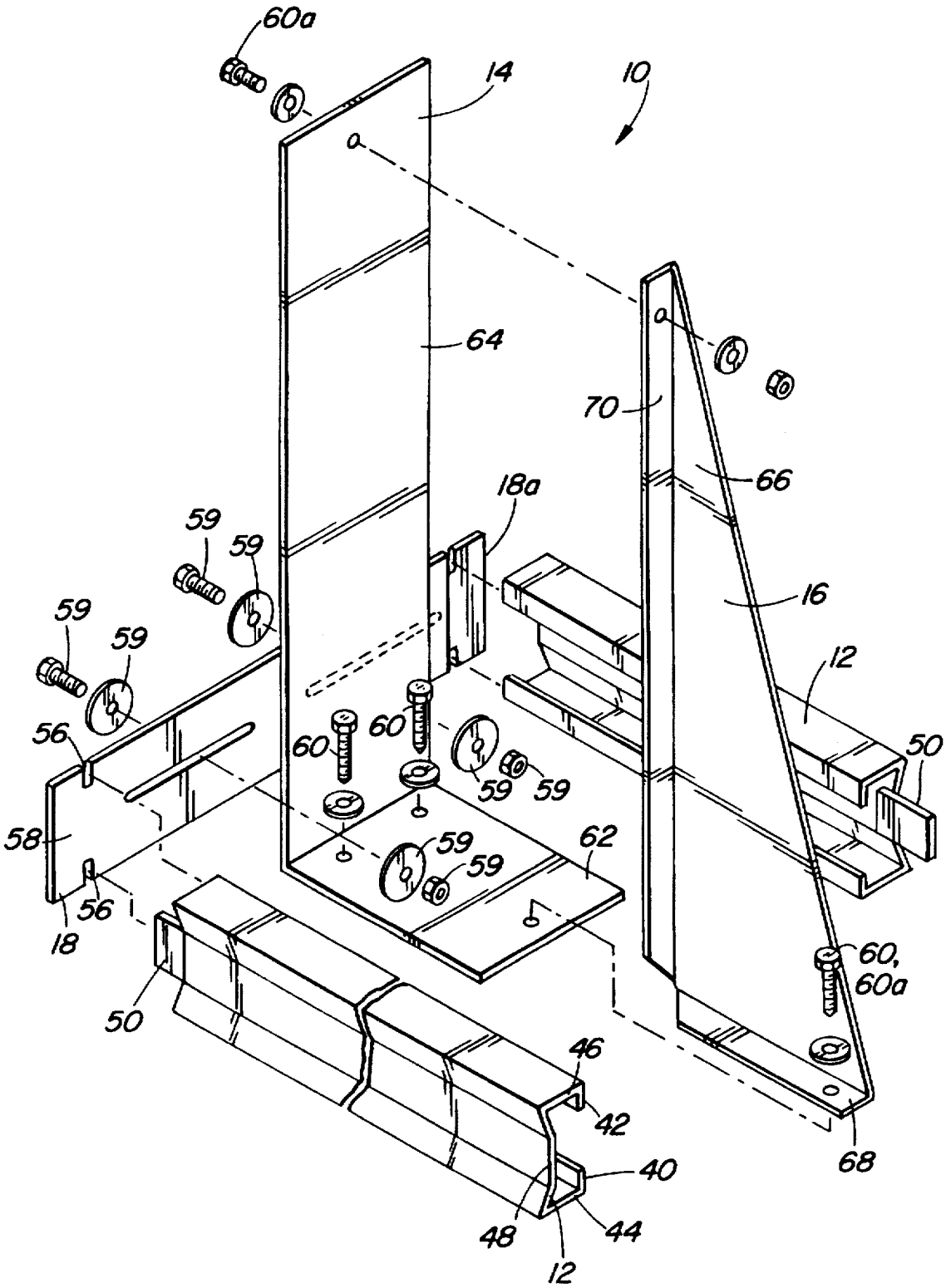
FIG. 1 is an end view of a concrete slab forming system in accordance with the invention showing the stacking of successive concrete layers.
Figure 2:
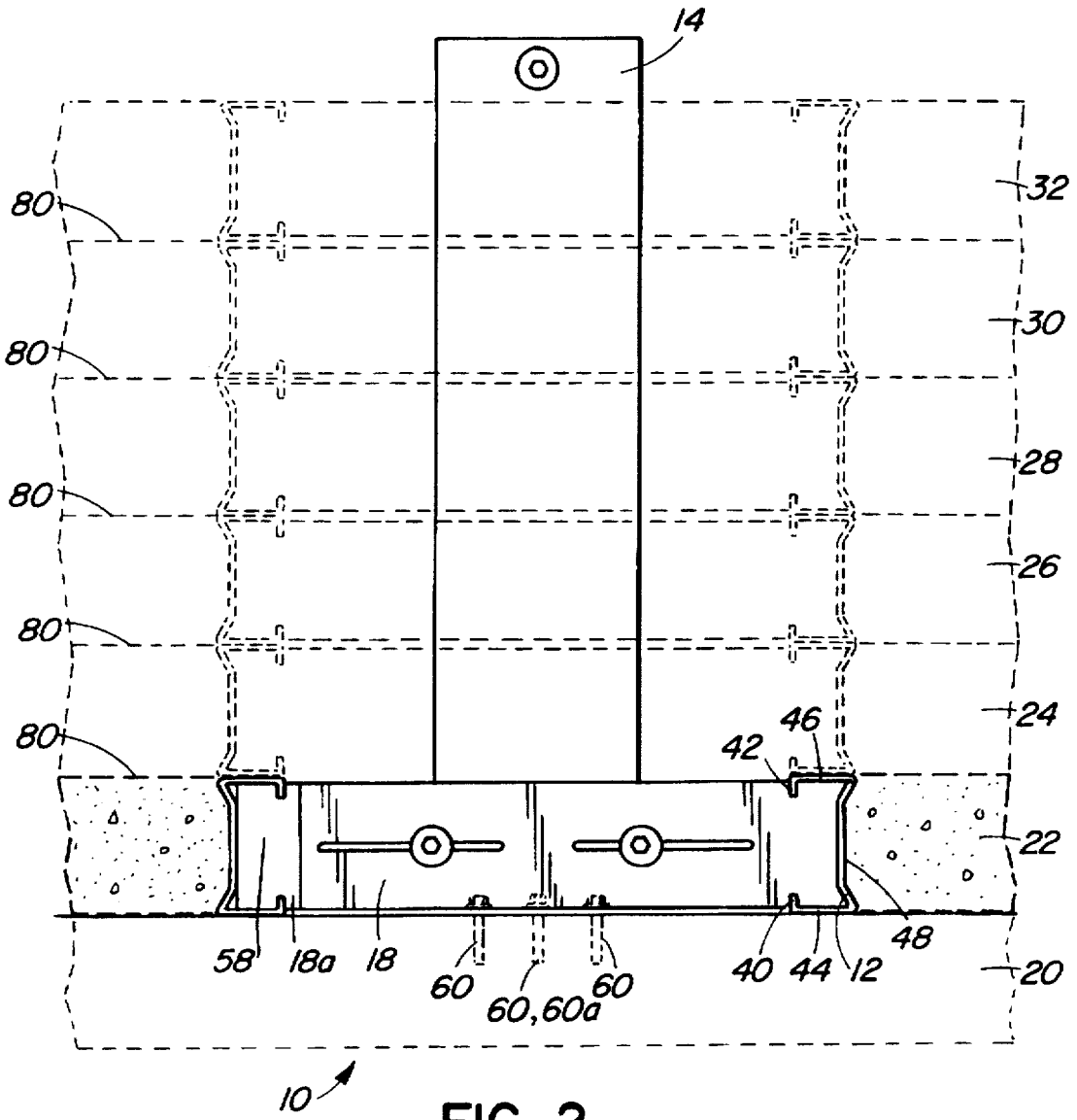
FIG. 2 is an exploded perspective view of a concrete slab forming system in accordance with the invention.

With reference to FIGS. 1 and 2, a concrete slab forming system 10 in accordance with the invention is shown. The system includes a concrete form member 12, a vertical plate member 14, a vertical stiffening member 16 and a horizontal adjustment member 18. As shown in FIG. 2, the system 10 is assembled over a work surface, normally a flat concrete slab 20.

Figure 3:
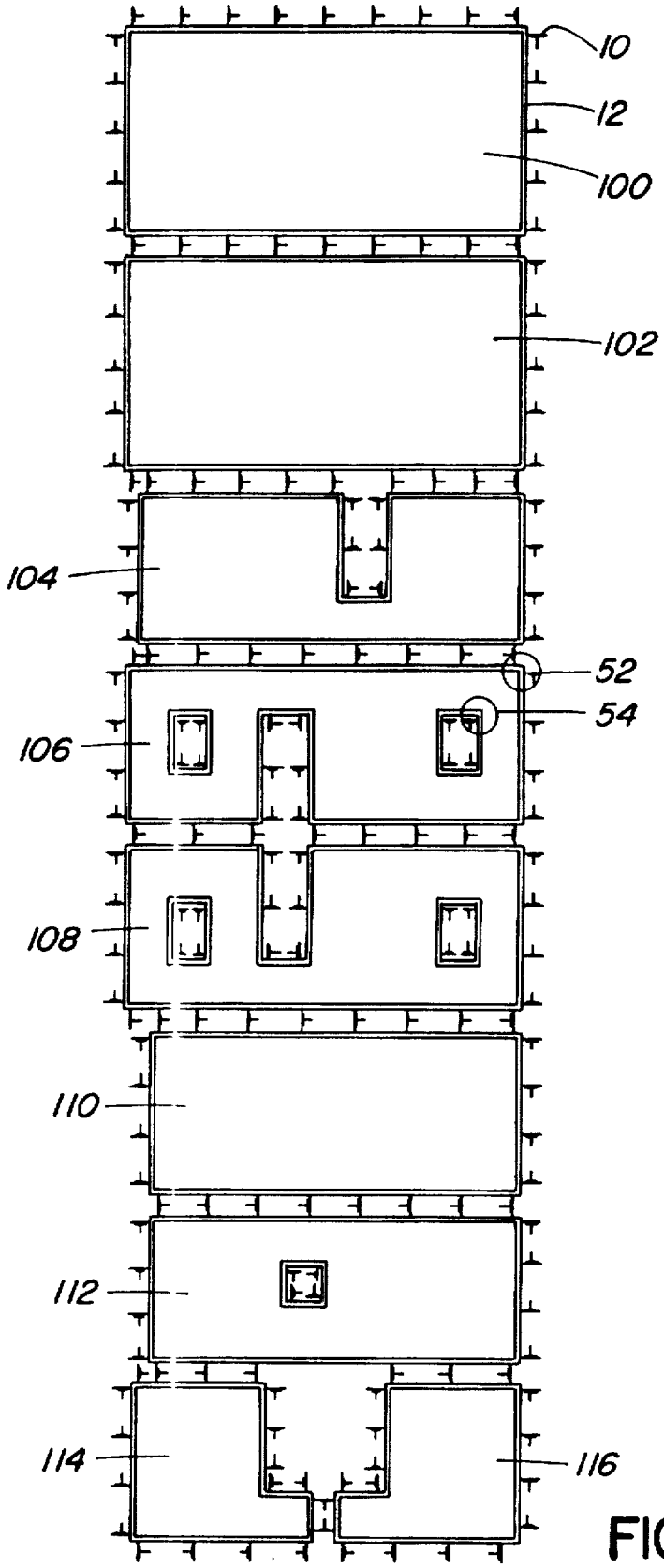
FIG. 3 is a plan view of building site utilizing the concrete slab forming system of the invention.

The system 10 allows for the successive pouring, curing and stacking of concrete slabs 22, 24, 26, 28, 30 and 32 one on top of the other on and above the work surface 20. In order to form such slabs, a number of form members 12 are arranged and interconnected to form an appropriately shaped areas as shown in FIG. 3 for specific concrete slabs. For example, the specific slab forms shown in FIG. 3 is representative of a design which may be used in the manufacture of a housing unit using tilt-up construction. In this specific example, nine distinct concrete slabs can be formed on a work surface which can be assembled to form a single housing unit. The distinct slabs include roof panels 100 and 102, interior partition 104, front wall 106, rear wall 108, side walls 110 and 112 and interior partitions 114 and 116. As can be seen, appropriate window and door openings can be provided on each panel as may be required for a specific design.

The concrete form member 12 may be any suitable concrete form as is known in the art and, preferably a member having a "C" cross-section with horizontal edges 44 and 46 and a vertical edge 48. As shown in FIGS. 1 and 2, the member has upwardly projecting lip 40 extending from the lower edge 44 of the member and a corresponding downwardly projecting edge 42 extending from the upper edge 46 of the member, the upwardly and downwardly projecting lips 40 and 42 adapted for configuration to the horizontal adjustment member 18. Furthermore, the vertical edge 48 of the concrete form member 12 is preferably offset in the inward direction as shown in FIGS. 1 and 2 to provide torsional stability to the form member 12. Still further, the concrete form member 12 may be provided with a tongue 50 to allow interconnection of the form members 12 to one another. In a typical application, where the system 10 is shipped to a work site, it would be preferable that the concrete form members 12 are in standard lengths up to a typical maximum of 12 feet. The concrete form members 12 may also include inside comer 52 or outside corner 54 shapes or other forms as would be understood by those skilled in the art to permit a full range of forming options.

The shape and structure of the concrete form member 12 imparts a bending and torsional stiffness to the member 12 thereby providing durability for repeated and long-term use.

As indicated above, the concrete form member 12 is adapted for configuration to one or more horizontal form members 18 through the upwardly 40 and downwardly 42 projecting edges. The horizontal adjustment member 18 is provided with recessed channels 56 on the upper and lower edges of the horizontal member 18 which define a tongue 58. The recessed channels 56 are adapted for receiving the upwardly and downwardly projecting edges 40 and 42 which thereby secure the tongue 58 within the form member 12.

The horizontal member 18 is also provided with means for attaching the horizontal member to the vertical member 14. This form of attachment preferably allows for complete linear adjustment freedom of the horizontal member 18 with respect to the vertical member 18 thereby providing for maximum flexibility during assembly of the components at a work site. As shown FIGS. 1 and 2, the means for attachment may include horizontal slits and an appropriate washer, nut and bolt system 59 for tightening the horizontal member 18 against the vertical member 14. The horizontal member 18 may be adapted for attachment to a single form 12 or forms on opposite sides of a vertical member as shown in the Figures. The horizontal member 18 may be a single member 18 with two ends adapted for configuration to a form 12 or, alternatively, have a single end adapted for configuration to a form 12 as shown in FIGS. 1 and 2. Overlapping horizontal members 18 and 18a may be configured to the vertical member 14 utilizing the same nut and bolt system 59 for both members.

The vertical support member 14 and vertical stiffening member 16 are attached to one another to provide vertical support and alignment to the concrete forms 12 through the horizontal member 18. The vertical support member 14 is attached to the work surface 20 by a suitable attachment means, such as anchor bolts 60 set within the work surface 20. As shown, the vertical support member has a base member 62 which lays flat on the work surface 20 and a vertical member 64. The vertical stiffening member 16 is provided with a main member and horizontal 68 and vertical 70 flanges which are configured for attachment of the vertical stiffening member 16 to the vertical support member 14 with bolts 60*a*. The vertical stiffening member 16 is also provided in a generally triangular design so as to minimize the quantity of material required for manufacturing and transport while providing a design which gives rigid support to the vertical support member 14.

While other designs of the vertical support member 14 and vertical stiffening member 16 could be employed, the two component design enables convenient stacking of each component for transportation. As can be appreciated, the vertical support member 14 with its 90° bend between the base member 62 and vertical member 64 enables a number of vertical support members 14 to be stacked with respect to one another into a compact arrangement for packing and transportation. Similarly, the vertical stiffening member 16 can be stacked in a similar manner.

Preferably, all components are fabricated from a corrosion resistant material such as galvanized steel to enhance the durability of each component for repeated use.

Assembly of the Concrete Slab Forming System

At a suitable work surface, the general layout of the various concrete slab components to be formed would be outlined on the work surface and appropriate concrete form members 12 loosely interconnected so as to correspond to the desired outline of the required concrete slab. The horizontal adjustment members 18 would be loosely configured to the forms 12 at this time by insertion of the tongues 58 within the forms 12 as described above. Vertical support members 14 and vertical stiffening members are positioned at an appropriate distance from the forms 12 and attached to the work surface by an appropriate fastening system such as anchor bolts. The horizontal adjustment members 18 are then attached to the vertical support members 14 and adjusted and tightened to ensure the correct size and shape of the concrete slab to be poured.

Upon assembly of the concrete forming system 10 with the desired forms on the work surface, a first concrete pour can be made with inclusion of rebar rods or mesh as appropriate. As would be understood by those skilled in the art, any surface finishing can be completed to ensure a smooth top surface for each slab as it is poured. After an appropriate setting-up period, typically 24 hours, a releasing agent can be applied to the top surface 80 of each slab of concrete in preparation for subsequent concrete pours. For all subsequent pours, a new form 12 and horizontal adjustment member 18 can be attached to the vertical support member 14 on top of the underlying form or alternatively the form 12 and horizontal adjustment member 18 can be loosened, lifted, adjusted and re-tightened to a new position on top of the first poured slab 22. A subsequent pour can then be completed as with the first pour. Still further pours can progress as described above (typically to a maximum of seven). After completion of the last pour, the entire stack of slabs is left to cure for an appropriate period of time (typically seven days) to permit sufficient curing for any subsequent handling and/or assembly.

Upon removal of the slabs from the work surface, new series of slabs can be manufactured on the work surface 20.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

I claim:

1. A concrete forming system enabling stacked pourings of concrete comprising:

a concrete form member;

a vertical plate member adapted for attachment to a work surface;

a vertical stiffening member adapted for attachment to the vertical plate member and for stiffening the vertical plate member;

horizontal adjustment member adapted for attachment to the vertical plate member, the horizontal adjustment member including means for horizontal positioning of the horizontal adjustment member and means for anchoring the concrete form member to the horizontal adjustment member.

2. A concrete forming system as in claim 1 wherein the concrete form member has a c-profile with an upwardly projecting edge and a downwardly projecting edge for configuration to corresponding recessed channels on the horizontal adjustment member.

3. A concrete forming system as in claim 1 wherein the concrete form member includes a tongue for attachment of adjacent concrete form members to one another.

4. A concrete forming system as in claim 1 wherein the vertical support member has a base member adapted for attachment to the work surface and a vertical member, the base member and vertical 90° with respect to one another.

5. A concrete forming system as in claim 4 wherein the vertical stiffening member has a triangular plate member, a vertical flange on one edge of the triangular plate member adapted for attachment to the vertical member and a horizontal flange adapted for attachment to the base member.

6. A concrete forming system as in claim 1 wherein the horizontal adjustment member includes at least one horizontal slot adapted for configuration of the horizontal adjustment member to the vertical support member.

7. A concrete forming system as in claim 2 wherein the concrete form member includes a tongue for attachment of adjacent concrete form members to one another.

8. A concrete forming system as in claim 7 wherein the vertical support member has a base member adapted for attachment to the work surface and a vertical member, the base member 90° with respect to the vertical member.

9. A concrete forming system as in claim 8 wherein the vertical stiffening member has a triangular plate member, a vertical flange on one edge of the triangular plate member adapted for attachment to the vertical member and a horizontal flange adapted for attachment to the base member.

10. A concrete forming system as in claim 9 wherein the horizontal adjustment member includes at least one horizontal slot adapted for configuration of the horizontal adjustment member to the vertical support member.

11. A concrete forming system enabling stacked pourings of concrete comprising:

a concrete form member having a c-profile with an upwardly projecting edge and a downwardly projecting edge, the concrete form member having a tongue for attachment of adjacent concrete form members to one another;

a vertical plate member having a base member adapted for attachment to the work surface and a vertical member, the base member 90° with respect to the vertical member;

a vertical stiffening member adapted for attachment to the vertical plate member and for stiffening the vertical plate member, the vertical stiffening member having a triangular plate member, a vertical flange on one edge of the triangular plate member adapted for attachment to the vertical member and a horizontal flange adapted for attachment to the base member;

horizontal adjustment member adapted for attachment to the vertical plate member and the upwardly projecting edge and downwardly projecting edge of the concrete form member, the horizontal adjustment member including at least one horizontal slot adapted for configuration of the horizontal adjustment member to the vertical support member.

* * * * *

UNITED STATES PATENT AND TRADEMARK OFFICE

CERTIFICATE OF CORRECTION

PATENT NO. : 5,766,645
DATED : June 16, 1998
INVENTOR(S) : Jan KAMINSKI

It is certified that error appears in the above-identified patent and that said letters patent is hereby corrected as shown below:

Column 4, line 1, change "end" to -exploded perspective-.
Column 4, line 4, change "exploded perspective" to -end-.

Signed and Sealed this

Eighth Day of August, 2000

*Attest:*

Q. TODD DICKINSON

*Attesting Officer*

*Director of Patents and Trademarks*